United States Patent [19]

Hoyer

[11] Patent Number: 4,662,625

[45] Date of Patent: May 5, 1987

[54] DECORRUGATING PAPER TRANSPORT

[75] Inventor: August Hoyer, Penfield, N.Y.

[73] Assignee: Xerox Corporation, Stamford, Conn.

[21] Appl. No.: 751,638

[22] Filed: Jul. 3, 1985

[51] Int. Cl.[4] ..... B65H 5/02; B65H 5/04

[52] U.S. Cl. ..... 271/272; 271/246; 493/406; 493/374; 162/197

[58] Field of Search ..... 271/272, 273, 274, 277, 271/226, 228, 114, 118, 119, 246, 153, 314, 275, 276, 188, 209; 100/176; 72/188; 493/406, 374; 162/197, 271

[56] References Cited

U.S. PATENT DOCUMENTS

| | | | |
|---|---|---|---|
| 3,954,261 | 5/1976 | Green et al. | 271/188 |
| 4,205,770 | 6/1980 | Wojdyla | 271/273 X |
| 4,326,915 | 4/1982 | Mutschler, Jr. | 162/271 |
| 4,418,905 | 12/1983 | Garavuso | 271/98 |
| 4,505,695 | 3/1985 | Billings | 493/459 |

FOREIGN PATENT DOCUMENTS

| | | | |
|---|---|---|---|
| 2804116 | 8/1978 | Fed. Rep. of Germany | 271/188 |
| 0121370 | 10/1978 | Japan | 271/119 |
| 58-100056 | 6/1983 | Japan . | |
| 58-100057 | 6/1983 | Japan . | |

OTHER PUBLICATIONS

R. R. Rubeling, Jr. "Automatic Sequential Document Stack Feed", IBM Technical Disclosure Bulletin, vol. 14, No. 9, p. 2789 (Feb., 1972).

*Primary Examiner*—Douglas C. Butler
*Attorney, Agent, or Firm*—William A. Henry, II

[57] ABSTRACT

A decorrugating sheet transport system includes a drive shaft with three drive rollers mounted for rotation in relation to three idler rollers. The three drive rollers have relieved areas on portions of their circumferences and are positioned on the drive shaft so that upon receiving the lead edge of a corrugated sheet only the two outer rollers drive the sheet initially. This allows the corrugations in the sheet to expand toward the outer rollers. Next, all three rollers drive the sheet for about a 30° arc and then the sheet is driven only by the center roller with the outer two rollers separated to allow the corrugations to dissipate to the edges of the sheet through a small gap between the outer rollers.

12 Claims, 8 Drawing Figures

DECORRUGATING PAPER TRANSPORT

BACKGROUND OF THE INVENTION

This invention relates to feeding sheets in a printing machine, and more particularly to an improved paper transport for sheets fed from a top vacuum corrugation feeder in such a machine.

High volume, high speed printing machines produce copies at a rate in excess of several thousand copies per hour, therefore the need for a sheet feeder to feed cut copy sheets to the machines in a rapid dependable manner has been recognized to enable full utilization of the machines' potential copy output. These sheet feeders must operate flawlessly to virtually eliminate the risk of damaging the sheets. Current top and bottom vacuum corrugation feeders are solutions to this high speed, high volume sheet feeding requirement, however, these feeders depend upon the principle of top or bottom sheet corrugation for sheet separation from a stack of sheets in a feed supply tray and as a result, a new problem has surfaced when transporting such a sheet through a conventional designed multi-roll transport system. The sheets are delivered corrugated to the transport system and the corrugation remains in the sheets and creates problems when transport around curves is required as well as copy quality and jam problems.

Accordingly, a solution is a decorrugating device consisting of a drive shaft with three drive rollers and an idler shaft with three complimentary idler rollers. The drive rollers are not completely cylindrical, but shaped so that the two identical sets of outer drive and idler rollers form driving nips during part of the rotation of the drive shaft. During this period corrugation spreads outwardly from the center. The center roller set then takes over the driving and the outer nips open allowing the corrugation to dissipate.

The foregoing and other features of the instant invention will be more apparent from a further reading of the specification and claims and from the drawings in which:

Figure 4A:
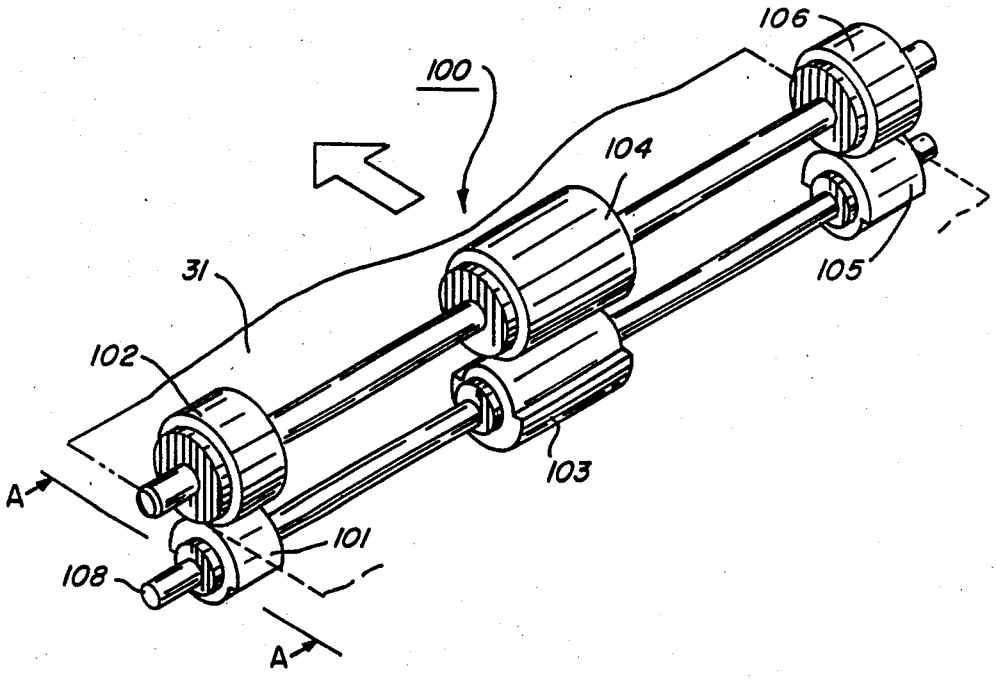

FIG. 4*a* is a partial isometric view of the decorrugating sheet transport device of the present invention showing a sheet being driven by two outer rollers.

Figure 4B:
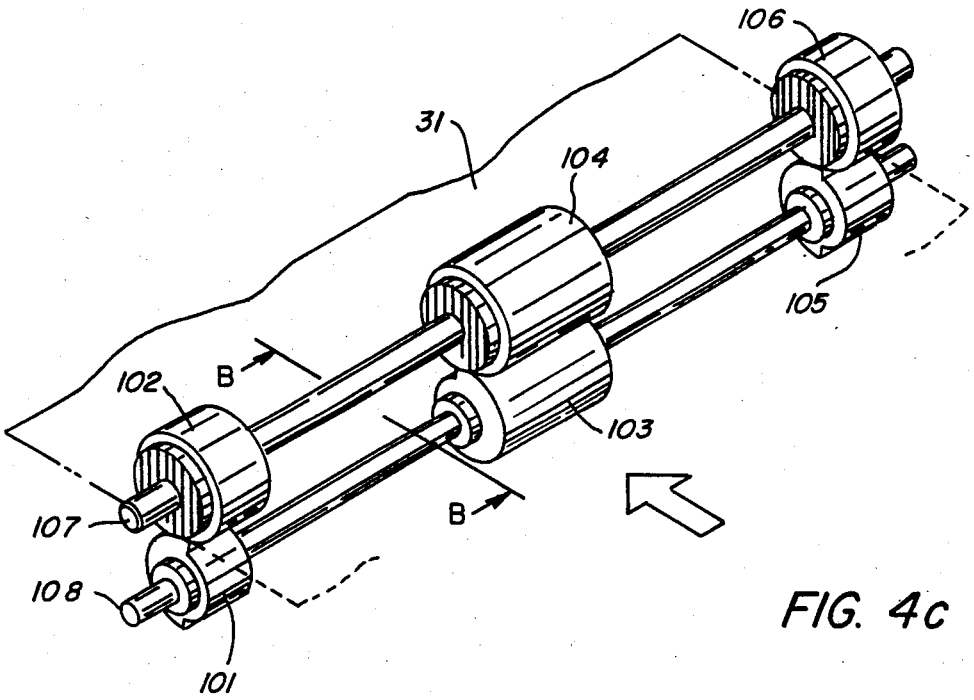

FIG. 4*b* is a partial isometric view of the decorrugating sheet transport device of the present invention showing a sheet being driven by three rollers.

Figure 4C:
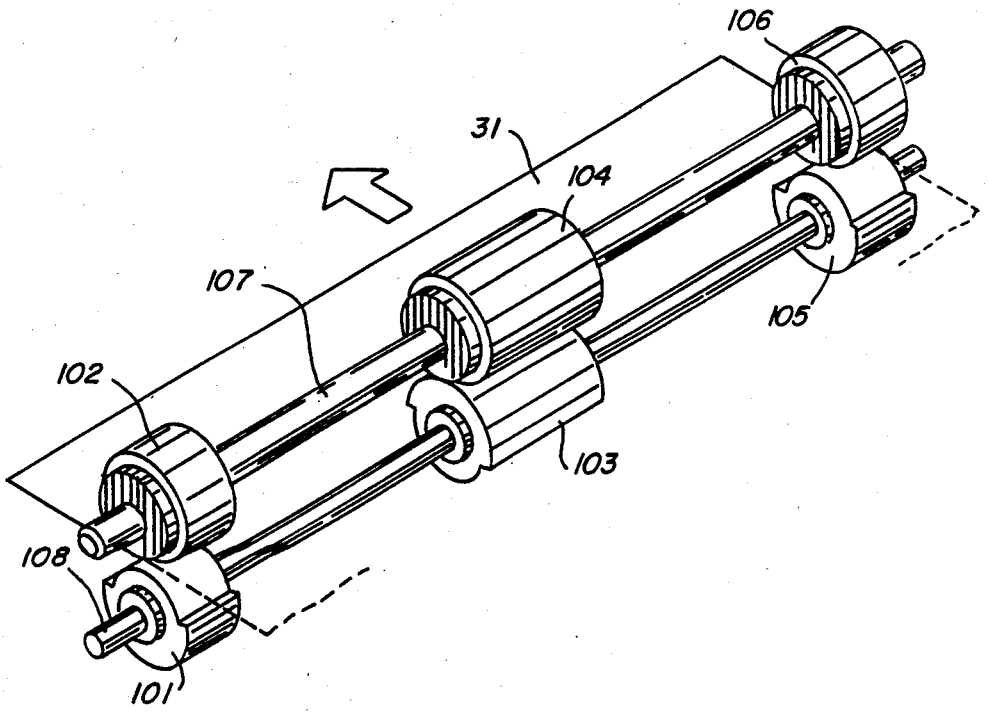

FIG. 4*c* is a partial isometric view of the decorrugating sheet transport of the present invention showing a sheet being driven by a center roller only.

Figure 5A:
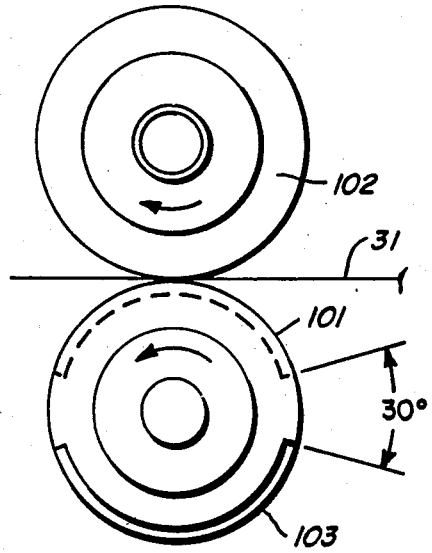

FIG. 5*a* is a partial end view of FIG. 4*a* in the direction of arrows A—A of FIG. 4*a* showing a sheet being driven by the outer rollers.

Figure 5B:
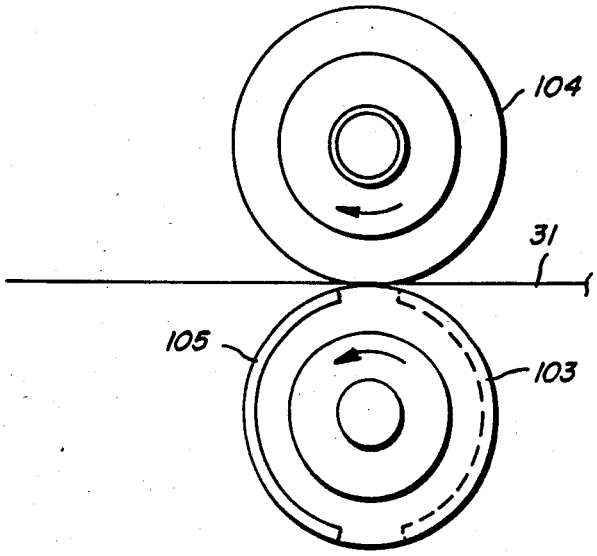

FIG. 5*b* is a partial end view of FIG. 4*b* in the direction of arrows B—B of FIG. 4*b* showing a sheet being driven by all three rollers.

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
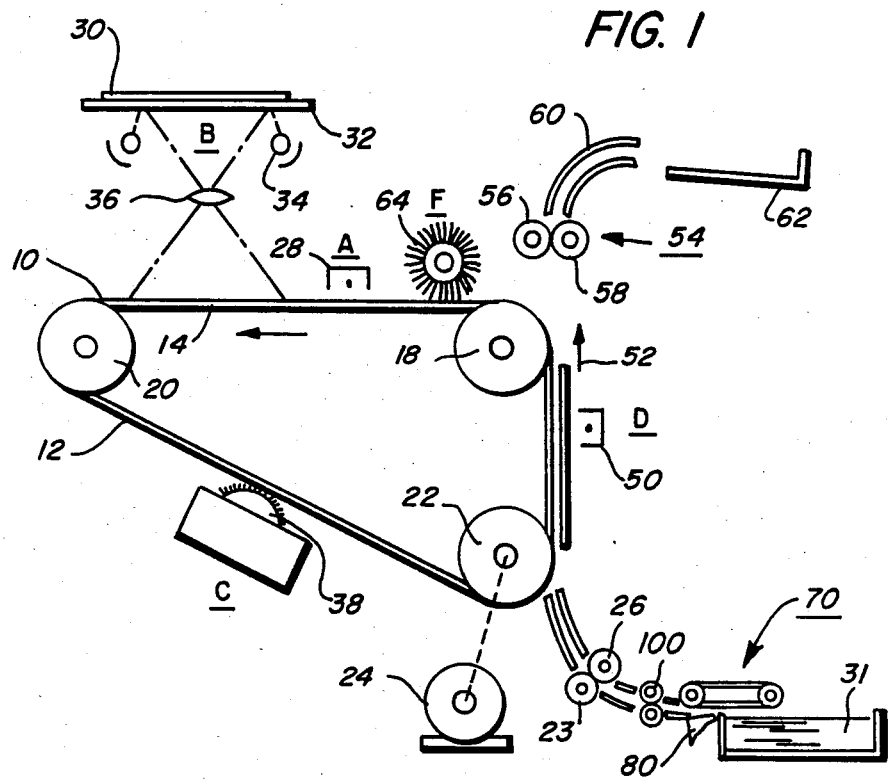
FIG. 1 is a schematic elevational view of an electrophotographic printing machine incorporating the features of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine incorporating a top feed vacuum corrugation feeder and the decorrugating method and apparatus of the present invention therein. It will become evident from the following discussion that the decorrugating sheet feeding system disclosed herein is equally well suited for use in a wide variety of devices and is not necessarily limited to its application to the particular embodiment shown herein. For example, the apparatus of the present invention may be readily employed in the nonxerographic environments and substrate transporting in general. The term sheet is used herein to mean materials of any kind, for example, paper, transparencies, etc.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photoconductive surface 12 deposited on a conductive substrate 14. Preferably, a photoconductive surface 12 is made from a selenium alloy with conductive substrate 14 being made from an aluminum alloy. Belt 10 moves in the direction of arrow 16 to advance successive portions of the photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records on electrostatic latent image on photoconductive surface 12 which corresponds to the information areas contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through decorrugating device 100 and rollers 23 and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Referring now to a particular aspect of the present invention, FIGS. 2–5*b* show a system employing the present invention in a copy sheet feeding mode. Alternatively, or in addition, the sheet feeder and decorrugating apparatus may be mounted for feeding document sheets to the platen of a printing machine. The sheet feeder is provided with a conventional elevator mechanism 41 for raising and lowering either tray 50 or a platform 42 within tray 40. Ordinarily, a drive motor is actuated to move the sheet stack support platform 42 vertically by a stack height sensor positioned above the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Vacuum corrugation feeder 70 and a vacuum plenum 75 are positioned over the front end of a tray 40 having copy sheets 31 stacked therein. Belts 71 are entrained around drive roller 24 as well as plenum 75. Belts 71 could be made into a single belt if desired. Perforations 72 in the belts allow a suitable vacuum source (not shown) to apply a vacuum through plenum 75 and belts 71 to acquire sheets 31 from stack 13. Air knife 80 with nozzle 82 applies a positive pressure to the front of stack 13 to separate the top sheet in the stack and enhance its acquisition by vacuum plenum 75. A suitable air knife that could be used in the present invention is disclosed in commonly assigned U.S. Pat. No. 4,418,905 entitled Sheet Feeding Apparatus, and is incorporated herein by reference. Corrugation rail 76 is attached or molded into the underside of plenum 75 and causes sheets acquired by the vacuum plenum to bend during corrugation so that if a second sheet is still sticking to the sheet having been acquired by the vacuum plenum, the corrugation will cause the second sheet to detack and fall back into the tray. In addition, fang gate members 44 and 45 are included with tray 40 to help stop any second sheet transport out of the tray. A sheet captured on belts 71 is forwarded through baffles 9 and 15 and into decorrugation forwarding drive rollers 101, 103 and 105 for transport to transfer station D.

Figure 2:
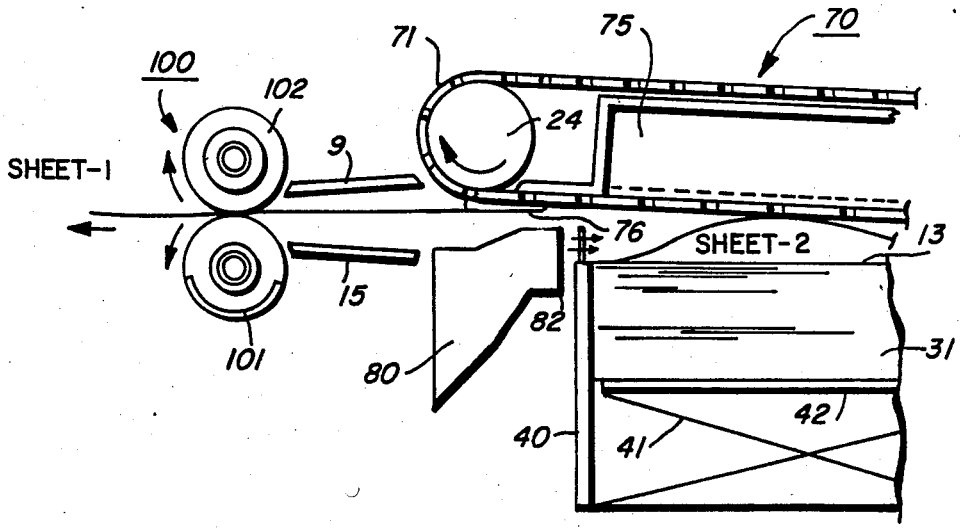
FIG. 2 is an enlarged cross-sectional view of the vacuum corrugation feeder in FIG. 1 showing the decorrugating sheet transport device of the present invention.

In order to improve sheet acquisition, increase reliability and decrease minimum feed speed, vacuum plenum 75 is equipped with a negative pressure source that is ON continuously during the feed cycle, with the only criteria for sheet feeding being that the motion of vacuum feedhead 70 is ceased prior to the trail edge of the acquired sheet exposing all of the vacuum ports. The next sheet is then acquired in a "traveling wave" fashion as shown in FIG. 2. This feeding scheme affords a reduction in noise due to the elimination of the valve associated with cutting the vacuum means ON and OFF. Also, increased reliability/decreased minimum feed speed is obtained, i.e., for given minimum required sheet acquisition and separation times, the removal of the valve from the vacuum system allows increased available acquisition/separation time per feed cycle and/or lower required minimum feed speeds. In addition, the removal of the valve from the vacuum system increases component reliability since no valve is required to actuate every feed cycle and electrical control is decreased because with no valve required in the vacuum system the required valve component input/output is eliminated. It should be understood that the valveless vacuum feedhead is equally adaptable to either bottom or top vacuum corrugation feeders.

As can be seen in FIG. 2, the ripple in sheet two makes for a more reliable feeder since the concavity of the sheet caused by continuously operating vacuum plenum 75 will increase the unbuckling of sheet three from sheet two. Sheet three will have a chance to settle down against the stack before sheet two is fed since air knife 80 has been turned off. Belts 71 are stopped just before sheet one uncovers the vacuum plenum completely in order to enhance the dropping of any sheets that are tacked to sheet two back down upon the stack and to feed the sheets in time with images produced on the photoreceptor. When a signal is received from a conventional controller to feed another sheet, belts 71 are turned in a clockwise direction to feed sheet two. Air knife 80 is also turned On and applied air pressure to the front of the stack to insure separation of sheet two from any other sheets and assist the vacuum plenum in lifting the front end of the sheet up against corrugation rail 76 which is an additional means of insuring against multi-sheet feeding. Lightweight flimsy sheet feeding is enhanced with this method of feeding since sheet two is easily adhered to the vacuum plenum while sheet one is being fed by transport system 100. Also, gravity will conform the front and rear portions of sheet two against the stack while the concavity produced in the sheet by the vacuum plenum remains.

Figure 3:
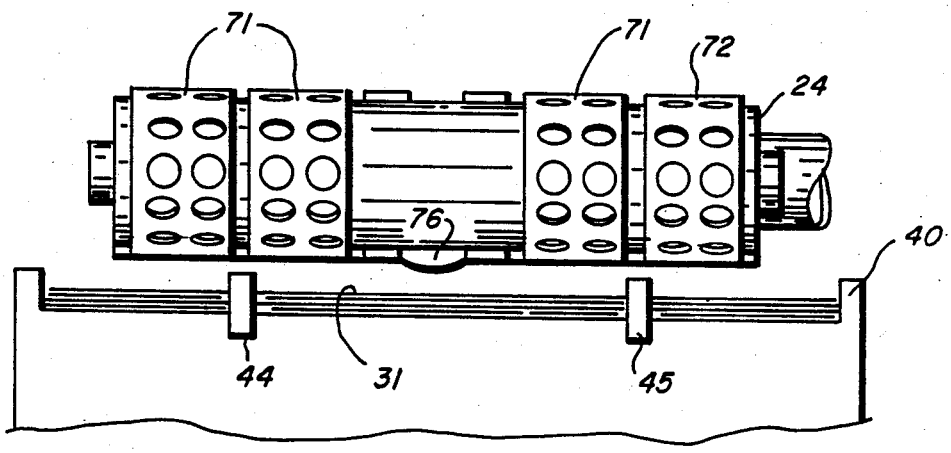
FIG. 3 is a partial end view of the sheet tray shown in FIG. 2.

Referring more particularly to FIG. 3, there is disclosed a plurality of feed belts 71 supported for movement on rollers. Spaced within the run of belts 71 there is provided a vacuum plenum 75 having an opening therein adapted for cooperation with perforations 72 in the belts to provide a vacuum for pulling the top sheet in the stack onto the belts 71. The plenum is provided with a projecting portion 76 so that upon capture of the top sheet in the stack by the belts a corrugation will be produced in the sheet. The flat surfaces of the vacuum belts on each side of the projecting portion of the vacuum plenum generates a region of maximum stress in the sheet which varies with the beam strength of the sheet. In the unlikely event more than one sheet is pulled to the belts, second sheet resists the corrugation action, thus gaps are opened between sheets one and two which extend to their lead edges. The gaps and channels reduce the vacuum levels between sheets one and two due to porosity in sheet one and provide for entry of separating air flow of the air knife 80.

By suitable valving and controls, it is desirable to provide a delay between the time the vacuum is applied to pull the document up to the feed belts and the start up of the belts to assure that the top sheet in the stack is captured before belt movement commences and to allow time for the air knife to separate sheet one from sheet two or any other sheets that were pulled up.

Turning to FIGS. 4*a–c*, an aspect of the present invention is shown for decorrugating sheets as they are being transported from vacuum corrugation feeder 70. The sheet transport system or device 100 is configured with a minimum of drive shafts including a take-away drive shaft 108 and an idler shaft 107. The take-away drive shaft has a decorrugating roller system thereon that consists of three rollers 101, 103 and 105 that are only partially cylindrical. Idler shaft 107 has cylindrical complimentary idler rollers 102, 104 and 106 mounted thereon to be driven by the drive rollers. The two outer rollers 101 and 105 on shaft 108 are spaced 175 mm apart and roller 103 is centered between the two and is approximately 40 mm wide. The three rollers are configured such that the two outer rollers drive a corrugated sheet leaving tray 40 for a time with the center roller not driving and thus, allowing the corrugation to expand toward the outer rollers. For the next time period, all three rollers are in contact with their opposite idler rollers and then for a third time period, the center roller is driving with the two outer rollers separated to allow the corrugation to dissipate through a small gap between the outer rollers. This cycle repeats as shaft 108 is rotated by conventional means.

In FIGS. 4*a* and 5*a*, in particular, a sheet 31 is shown corrugated as it leaves vacuum corrugation feeder (VCF) 70 and is driven by segmented drive rollers 101 and 105 in association with idler rollers 102 and 106. Center roller pair 103, 104 is disengaged at this time and as a result, the corrugations will expand toward the outer rollers. As the sheet continues travel as shown in FIGS. 4*b* and 5*b* for about a 30° arc of rotation, all three roller pairs are in driving contact with the sheet. Next, as depicted in FIG. 4*c*, the corrugations which were in the sheet have dissipated and the sheet is straight due to it being driven by only center roller pair 103, 104 and the space for corrugation dissipation being provided between roller pairs 101, 102, and 105, 106. It can be seen that the segmented portions of drive rollers 101 and 105 are removed from adjacent idler rollers 102 and 106 respectively as the sheet is being driven by roller 103 thus allowing any uneveness in the sheet to spread outward. The cycle is repeated as shaft 108 is rotated.

It should now be apparent that the decorrugating sheet transport apparatus has been disclosed that operates to remove undulations or corrugations from a sheet during transport. The apparatus includes three drive rollers and opositely positioned idler rollers forming three roller pairs. The drive rollers are irregularly shaped such that as the shaft upon which the drive rollers are mounted is rotated, a sheet is first driven by a first and third of the roller pairs with the second roller pair not in driving engagement with the sheet. With continued rotation of the shaft, all three of the roller pairs are in driving contact with the sheet. Subsequently, only the second and center of the roller pairs drive the sheet to thereby allow any wrinkles, corrugations, or undulations in the sheet to spread out to the edges of the sheet and straighten the sheet. This method of straightening a sheet is repeated constantly as the drive shaft is rotated.

In addition to the method and apparatus disclosed above, other modifications and/or additions will readily appear to those skilled in the art upon reading this disclosure and are intended to be encompassed within the invention disclosed and claimed herein.

What is claimed is:

1. A decorrugating device for removing corrugations from a sheet passing therethrough, comprising:

an idler shaft having at least three idler rollers mounted thereon;

a drive shaft; and at least three segmented drive rollers mounted on said drive shaft such that only two of said drive rollers form driving nips with two of said idler rollers during part of each complete rotation of said drive shaft to allow corrugations in the sheet to spread outwardly from the center of the sheet, and wherein the other of said at least three drive rollers takes over the driving of the sheet for the remaining rotation of said drive shaft while said driving nips formed by said two of said drive rollers open allowing the corrugations to dissipate.

2. The decorrugating device of claim 1, wherein one arc of rotation of said drive shaft causes all of said drive rollers to be in driving contact with the sheet.

3. A sheet transport system that removes corrugations from sheets in transit, comprising:

a plurality of idler roller means; and a plurality of drive roller means adapted to receive corrugated sheets in at least one nip formed between said idler roller means and said drive roller means in order to remove the corrugations from the sheets, said drive roller means including irregular circumferences such that the sheets initially are driven by contact of said drive roller means with outer edges of the sheets, then driven by contact of said drive roller means with said outer edges as well as center portions of the sheets and thereafter are driven only by contact of said drive roller means with said center portions of the sheets.

4. The sheet transport system of claim 3, wherein said idler roller means and said drive roller means are mounted on respective separate, single shafts.

5. The sheet transport system of claim 4, wherein said idler roller means are cylindrical and said drive roller means are only partially cylindrical.

6. The sheet transport system of claim 3, wherein said drive rollers means removes corrugations from the sheets without placing a curl in the sheets.

7. The sheet transport system of claim 3, wherein said drive roller means includes outer circumference portions that are discontinuous.

8. A method of decorrugating sheets during transport, comprising the steps of:

providing a plurality of idler rollers on a first shaft;

providing on a second shaft a plurality of drive rollers that form nips with said idler rollers; and configuring the circumference of said drive rollers so that upon rotation of said drive rollers a sheet is initially driven along its outer edges to allow any corrugations in the sheet to expand toward the outer edges of the sheet, then is driven along said outer edges as well as center portion and subsequently driven only by drive roller contact with its center portion.

9. The method of claim 8, wherein said plurality of idler and drive roller comprise three roller pairs.

10. The method of claim 9, wherein all of said roller pairs contact the sheet over an arc of 30°.

11. A method of decorrugating sheets in transit, comprising the steps of:

providing three sets of rollers or two shafts; and arranging said rollers such that two outer roller sets drive a sheet for a period, then the sheet is driven by all three roller sets and afterwards only one roller set drives the sheet.

12. A device for removing corrugations from a sheet, comprising:

a first shaft having a plurality of idler rollers mounted thereon; and a second shaft having a plurality of drive rollers arranged in relation to said idler rollers to form a plurality of roller sets such that the sheet is driven by at least two of said roller sets, then the sheet is driven by all of said roller sets and finally only by one of said roller sets.

* * * * *